US006702436B2

(12) United States Patent
Haines et al.

(10) Patent No.: US 6,702,436 B2
(45) Date of Patent: Mar. 9, 2004

(54) FLUID EJECTION CARTRIDGE INCLUDING A COMPLIANT FILTER

(75) Inventors: Paul Mark Haines, Lebanon, OR (US); Mark A. DeVries, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 31 days.

(21) Appl. No.: 10/066,200

(22) Filed: Jan. 30, 2002

(65) Prior Publication Data

US 2003/0142184 A1 Jul. 31, 2003

(51) Int. Cl.[7] ..... B41J 2/175
(52) U.S. Cl. ..... 347/93; 347/87
(58) Field of Search ..... 347/92, 93, 85–87

(56) References Cited

U.S. PATENT DOCUMENTS 5,872,584 A 2/1999 Hauck et al. ..... 347/86
5,880,748 A * 3/1999 Childers et al. ..... 347/6
6,084,617 A 7/2000 Balazer ..... 347/86
6,084,618 A 7/2000 Baker ..... 347/93
6,152,560 A 11/2000 Hollands ..... 347/93
6,250,747 B1 * 6/2001 Hauck ..... 347/86
6,260,957 B1 7/2001 Corley, Jr. et al. ..... 347/63
6,270,205 B1 8/2001 Takata ..... 347/85
2003/0150821 A1 * 8/2003 Bates et al. ..... 210/767

* cited by examiner

*Primary Examiner*—Judy Nguyen
(74) *Attorney, Agent, or Firm*—Donald J. Coulman

(57) ABSTRACT

A fluid ejection cartridge includes a fluid container that has both a fluid inlet and a fluid outlet. The fluid ejection cartridge has one or more fluid ejectors fluidically coupled to the fluid container outlet and a fluid valve fluidically coupled to the fluid container inlet. The fluid ejection cartridge has a filter assembly having a compliant portion with an internal volume fluidically coupled to the fluid container outlet such that the internal volume changes when fluid flows into the fluid container.

55 Claims, 9 Drawing Sheets

FLUID EJECTION CARTRIDGE INCLUDING A COMPLIANT FILTER

BACKGROUND

DESCRIPTION OF THE ART

Over the past decade, substantial developments have been made in the micro-manipulation of fluids in fields such as electronic printing technology using inkjet printers. As the volume of fluid manipulated or ejected decreases the susceptibility to clogging of fluid channels and nozzles has increased. Fluid ejection cartridges provide a good example of the problems facing the practitioner in preventing the clogging of microfluidic channels and nozzles due to particulates.

Fluid ejection cartridges typically include a fluid reservoir that is fluidically coupled to a substrate that is attached to the back of a nozzle layer containing one or more nozzles through which fluid is ejected. The substrate normally contains an energy-generating element that generates the force necessary for ejecting the fluid held in the reservoir. Two widely used energy generating elements are thermal resistors and piezoelectric elements. The former rapidly heats a component in the fluid above its boiling point causing ejection of a drop of the fluid. The latter utilizes a voltage pulse to generate a compressive force on the fluid resulting in ejection of a drop of the fluid.

Currently there is a wide variety of highly-efficient inkjet printing systems in use, which are capable of dispensing ink in a rapid and accurate manner. However, there is a demand by consumers for ever-increasing improvements in speed and image quality. To improve image quality, the size or diameter of each nozzle typically decreases. For example, today printers generally have 300 to 600 dpi (dots per inch). In order to improve print speed the number of nozzles necessarily increases. Thus, improvements in both image quality and speed have led to a decrease in the size of the nozzles as well as an increase in the number of nozzles on a printhead. This utilization of a greater number of smaller nozzles has created a greater degree of susceptibility to plugging from particulates in the ink supply. The plugging of a nozzle results in serious degradation of the image or print quality of the printer system.

In order to prevent the nozzle system from becoming clogged with particulate matter, a mechanical filter element is typically disposed in the ink jet print cartridge such that the ink is filtered before it is supplied to the nozzle system. If the ink is not filtered it would tend to clog or block the nozzles. These mechanical filters are generally screens and typically made of stainless steel woven mesh. They are attached to what is generally referred to as a standpipe. The standpipe provides fluid communication between the ink reservoir of the print cartridge and the fluid ejectors. This mesh is typically rigidly secured around the edges to the standpipe to prevent leakage of ink around the filter element.

In addition, in an effort to reduce the cost and size of ink jet printers and to reduce the cost per printed page, printers have been developed having small, moving printheads that are connected to large stationary ink supplies. This development is called "off-axis" printing and has allowed the large ink supplies to be replaced as it is consumed without requiring the frequent replacement of the costly printhead containing the fluid ejectors and nozzle system. However, the typical "off-axis" system requires numerous flow restrictions between the ink supply and the printhead, such as additional orifices, long narrow conduits, and shut off valves. To overcome these flow restrictions and to also provide ink over a wide range of printing speeds, ink is now transported to the printhead at an elevated pressure. A pressure regulator is typically added to deliver the ink to the printhead at the optimum backpressure.

Further, an "off-axis" printing system strives to maintain the back pressure of the ink within the printhead to within as small a range as possible. Changes in back pressure greatly affect print density as well as print and image quality. In addition changes in back pressure can cause either the ink to drool out of the nozzles or to deprime the printhead. As consumer demands push the technology to ever smaller nozzles it becomes necessary to filter ever smaller particles from the ink. However, mechanical filter elements capable of filtering smaller particles typically require a larger pressure drop across the filter medium to generate the same flow rate as a larger particle filter. Thus, the requirement to filter smaller particles yet maintain the back pressure of the ink within the printhead to within as small a range as possible has produced a problem in inkjet technology development.

SUMMARY OF THE INVENTION

A fluid ejection cartridge includes a fluid container that has both a fluid inlet and a fluid outlet. The fluid ejection cartridge has one or more fluid ejectors fluidically coupled to the fluid container outlet and a fluid valve fluidically coupled to the fluid container inlet. The fluid ejection cartridge has a filter assembly having a compliant portion with an internal volume fluidically coupled to the fluid container outlet such that the internal volume changes when fluid flows into the fluid container.

DETAILED DESCRIPTION OF THE INVENTION

Figure 1:
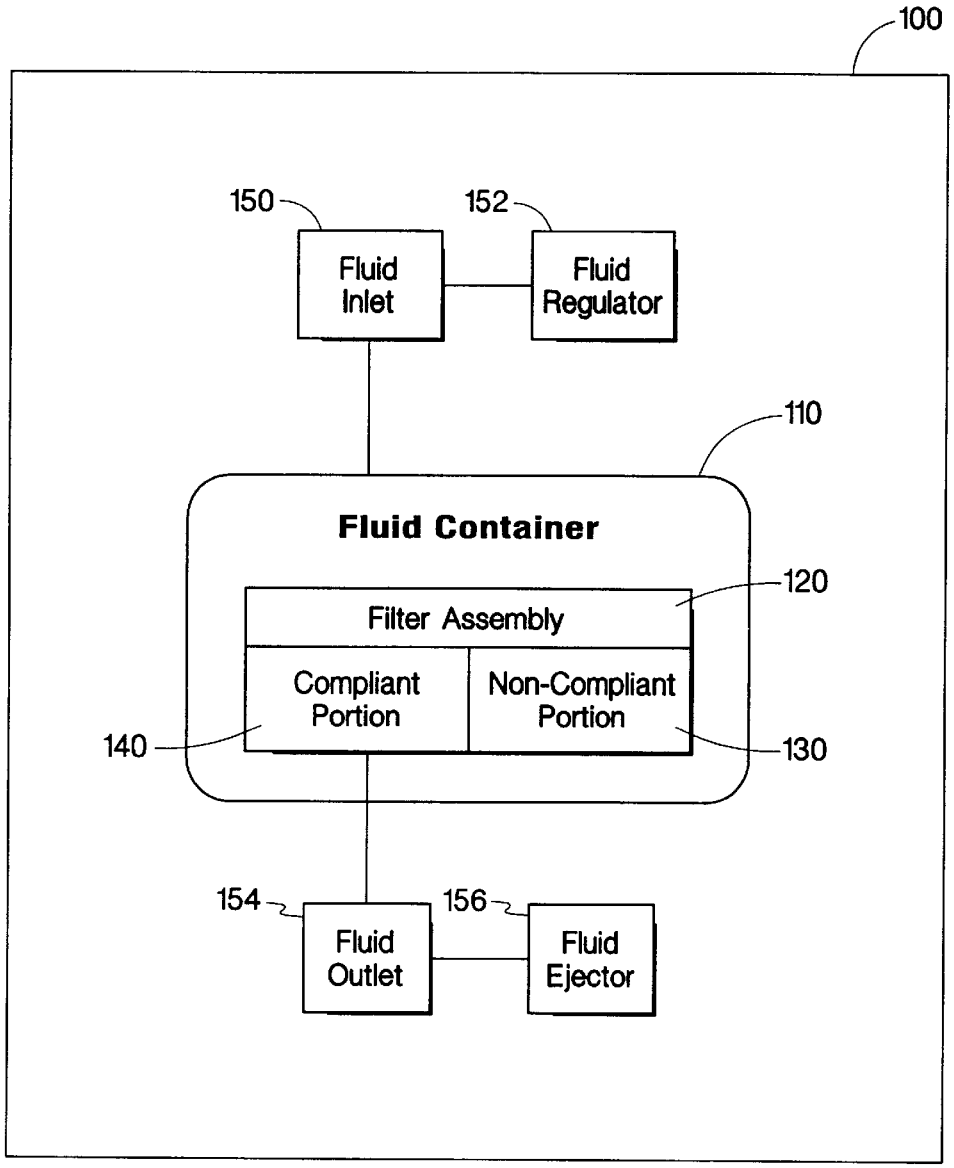
FIG. 1 is a block diagram of a fluid ejection cartridge according to an embodiment of the present invention.

Referring to FIG. 1, an embodiment of fluid ejection cartridge 100 of the present invention in a simplified block diagram is shown. In this embodiment, filter assembly 120 includes compliant portion 140 and non-complaint portion 130 disposed in fluid container 110. However, depending on the particular application in which fluid ejection cartridge 110 will be used, filter assembly 120 may also be located outside of fluid container 110, such as between fluid container 110 and fluid outlet 154. Fluid inlet 150 is fluidically coupled to fluid container 110 so that when fluid regulator 152 or regulator is in an open state fluid can flow from a fluid supply (not shown) into fluid container 110. Fluid in container 110 flows through filter assembly 120 through fluid outlet 154 to fluid ejector 156, as fluid is ejected from fluid ejection cartridge 100 through one or more nozzles (not shown) by activating fluid ejector 156. When fluid regulator 152 causes additional fluid to flow into fluid container 110, compliant portion 140 of filter assembly 120 responds to changes in pressure, thereby dampening pressure transients created by the opening of the valve typical of most valves used as fluid regulator 152.

Many fluid ejection delivery systems strive to keep the pressure of the fluid within fluid ejection cartridge 100 constant. Fluid flow is generally controlled by a fluid delivery system. The fluid delivery system regulates the pressure of the local fluid supply within fluid ejection cartridge 100 to a pressure less than ambient, which is generally referred to as backpressure. The backpressure range is controlled to keep the backpressure from affecting the ejecting frequency and amount of fluid ejected out of fluid ejection cartridge 100. If the backpressure is equal to or greater than ambient pressure, fluid will leak or drool out of the one or more nozzles. If the backpressure is much less than ambient pressure, the nozzles and area around fluid ejector 156 will not properly refill. Typical fluid ejection cartridges utilize a regulator to control the backpressure over a range of fluid flow rates. The particular pressure and flow rates depend on the particular application of the fluid ejection cartridge.

Figure 2A:
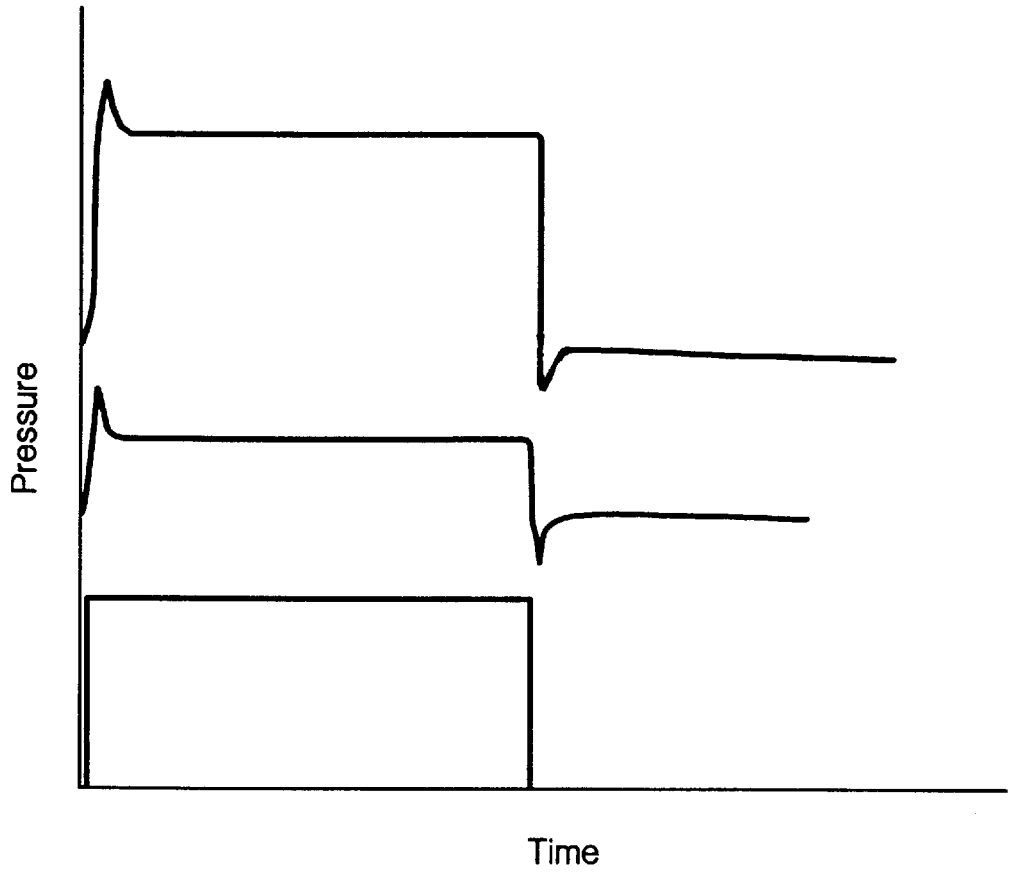
FIG. 2*a* is graph of pressure as a function of time in a fluid ejection cartridge according to an embodiment of the present invention.

The transient pressure response at a fixed flow rate for a typical regulator coupled to a fluid ejection cartridge having a non-compliant filter is shown graphically in FIG. 2*a*. The bottom curve represents the transient pressure response of the filter, where the rising edge at the left side signifies the fluid ejector turning on and the peak indicates the start of fluid flow into the fluid container. The falling edge at the right side signifies the fluid ejector shutting off stopping fluid flow. The middle curve represents the transient pressure response of fluid container 110, where the peak on the left side indicates that the backpressure within fluid container 110 exceeds the steady state pressure for a short period of time. When fluid stops flowing as depicted on the right side of the middle curve the backpressure undershoots the steady state pressure of fluid ejection cartridge 100. The top curve represents the transient pressure response in the vicinity of fluid ejector 156 where the peak on the left side indicates that the backpressure exceeds the steady state backpressure for a short period of time at fluid ejector 156 resulting in a pressure spike. Thus, the fluid ejector pressure represents, for a system utilizing a non-compliant filter, the combined effect of the transient pressure response of the filter and the fluid container 110. In the interval while the backpressure at fluid ejector 156 exceeds a predetermined value the drop size or amount of the fluid ejected will vary from its steady state value.

Figure 2B:
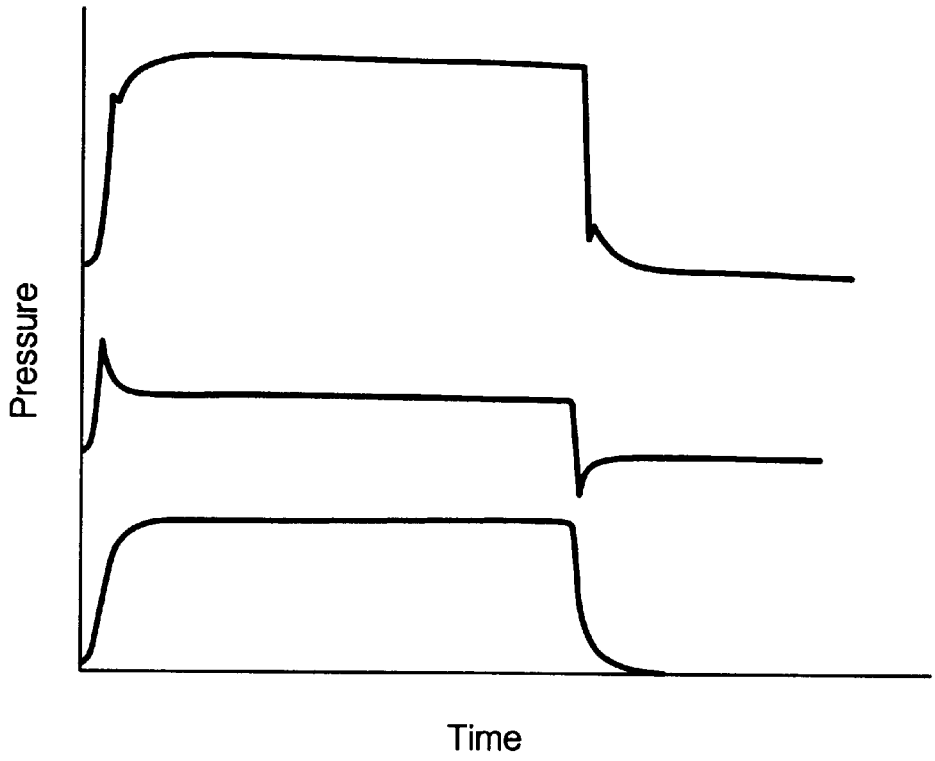
FIG. 2*b* is graph of pressure as a function of time in a fluid ejection cartridge according to an embodiment of the present invention.

The transient pressure response at a fixed flow rate for a typical regulator coupled to a fluid ejection cartridge having a compliant filter portion is shown graphically in FIG. 2*b*. The bottom curve represents the transient pressure response of the filter, where the rising edge on the left side, again signifies the fluid ejector turning on starting fluid flow. However, unlike a non-complaint filter, the internal volume of compliant portion 140 of filter assembly 120 decreases, in response to the flow transient, providing a more gradual rise in pressure. When the fluid ejector turns off, stopping fluid flow, the internal volume of compliant portion 140 increases eventually returning to substantially the same volume before filling started. This increase in volume provides a more gradual decrease in pressure as shown on the right side of the bottom curve when compared to a non-compliant filter. The middle curve represents the transient pressure response of fluid container 110, and is substantially the same as that shown in FIG. 2*a* for a non-compliant filter. The top curve again represents the transient pressure response in the vicinity of fluid ejector 156. The fluid ejector pressure, again, represents the combined effect of the transient pressure response of filter assembly 120 and fluid container 110. By utilizing compliant portion 140, the pressure spike observed using a non-compliant filter has been attenuated. Such attenuation provides a more uniform drop size during refill.

Figure 3A:
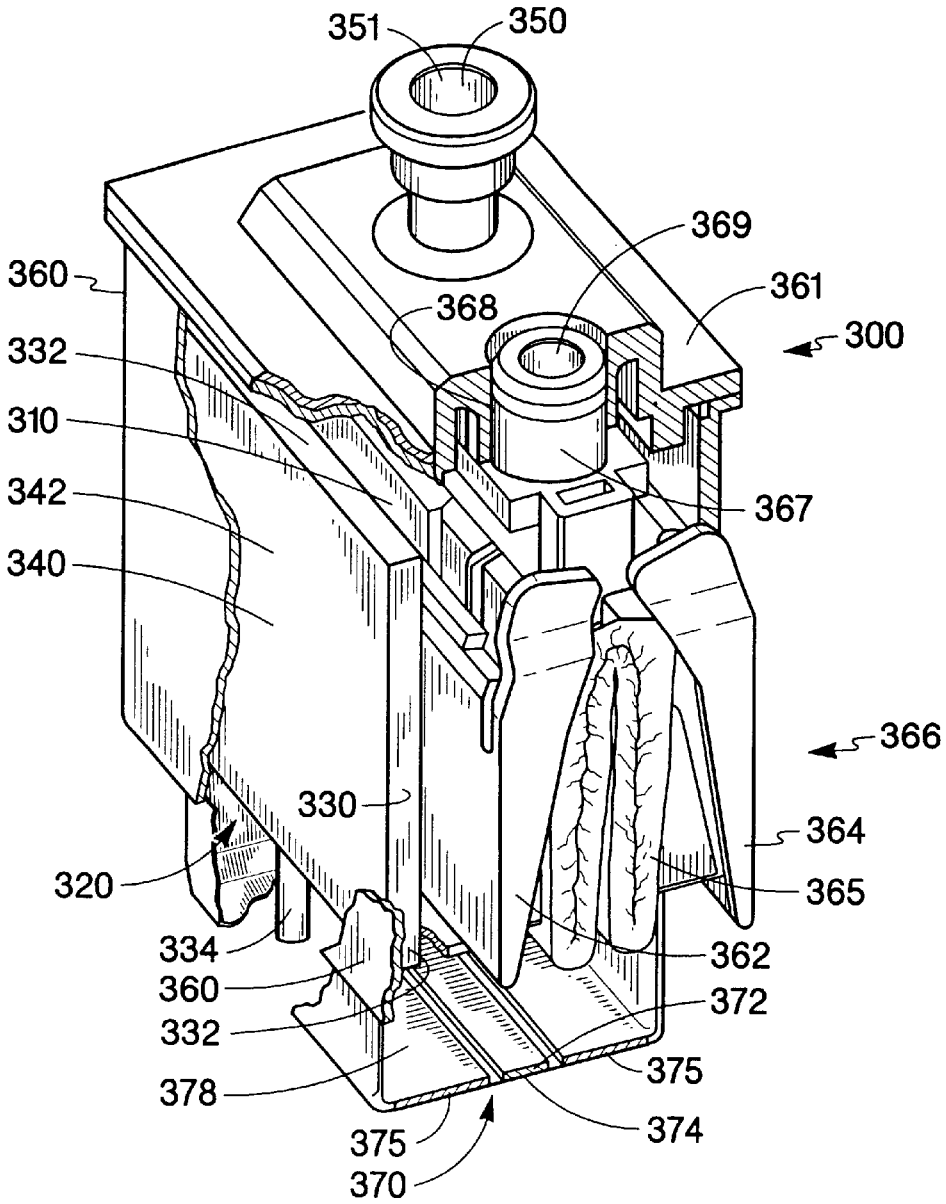
FIG. 3*a* is a perspective view of a fluid ejection cartridge according to an embodiment of the present invention.

Referring to FIG. 3*a* an exemplary embodiment of the present invention is shown in perspective view. In this embodiment, pen body 360 forms the walls of fluid container 310 for fluid ejection cartridge 300. Fluid ejector head 370 includes one or more fluid ejectors disposed on substrate 372. Preferably, substrate 372, nozzle layer 374, nozzles (not shown), and a chamber layer (not shown) form what is generally referred to as an ejector head. However, depending on the particular application and fluid ejection properties desired, other embodiments may utilize nozzle layer 374 with flexible circuit 375 integrated to form one part. Nozzle layer 374 contains one or more nozzles (not shown) through which fluid is ejected. Flexible circuit 375 of the exemplary embodiment is a polymer film and includes electrical traces (not shown) connected to electrical contacts (not shown). The electrical traces and contacts to bond pads (not shown) on substrate 372 provide electrical connection for fluid ejection cartridge 300. Preferably the one or more fluid ejectors are deposited onto substrate 372 using conventional semiconductor processing equipment to create the various thin films utilized in forming the fluid ejectors.

Located within pen body 360 is filter assembly 320 that is fluidically coupled to standpipe 378 via filter fitment 334. Filter assembly 320 is shown in plan view in FIG. 3*b*. Filter assembly 320 includes filter frame 332 that forms non-complaint portion 330. In addition, a portion of filter frame 332 forms filter fitment 334 that is, preferably, press-fit into a mating structure in standpipe 378. Compliant portion 340 includes filter material 342 that is, preferably, heat staked to filter frame 332 so that outer surface 341 of filter material 342 and 344 forms a convex shape. However, depending on the particular materials utilized for filter material 342 and filter frame 332, adhesives and other mechanical fastening methods may also be utilized to attach filter material 342 to filter frame 332.

Filter material 342 can be any of the filter materials well known in the art. The actual filter material utilized will depend both, on the particular application in which fluid ejection cartridge 300 will be utilized, as well as on characteristics or criteria of the filter material such as filtration efficiency, pressure drop, and chemical and thermal robustness to name a few. Preferably, the filter material is a polymer. However, materials woven from fibers of metal, ceramic, or glass can also be utilized. More preferably filter material 342 is a porous membrane such as polysulfone or polytetrafluoroethylene.

An exemplary filter material is a polyester/polysulfone/polyester three-layer film. The mean pore size of filter material 342 can range from about 1 micron to about 50 microns, preferably ranging from about 2 microns to about 10 microns. Typically the mean pore size is about one third the size of the smallest feature that the fluid flows through. In addition, filter material 342 exhibits a flow rate of between about 20 milliliters per min (ml/min.) to about 300 ml/min. at a pressure less than about 8 inches of water (in. H2O) at a viscosity of less than about 25 centipoise (cp). However, filter material 342, preferably, exhibits flow rates of between about 40 ml/min. to about 100 ml/min. at a pressure less than about 5 in. H2O at a viscosity of less than about 15 cp. More preferably, filter material 342 exhibits flow rates of between about 45 ml/min. to about 55 ml/min. at a pressure less than about 2 in. H2O at a viscosity of less than about 5 cp.

Filter frame 332 can be formed from any of the metal, polymer or ceramic materials well known in the art. The actual frame material utilized will depend both, on the particular application in which fluid ejection cartridge 300 will be utilized, as well as on characteristics of the filter material such as the materials chemical and thermal robustness. Preferably, the frame material is a thermoplastic polymer, and more preferably an injection moldable thermoplastic polymer such as polyethylene, polypropylene or polyester to name a few.

Also located within pen body 360 is regulator 366 that includes pressure regulator lever 362, accumulator lever 364, and flexible bag 365 as shown in FIG. 3*a*. Flexible bag 365 is illustrated as fully inflated in FIG. 3*a*. Pressure regulator lever 362 and accumulator lever 364 are urged together by a spring (not shown). In opposition to the spring, flexible bag 365 spreads the two levers (362, 364) apart as it inflates outward. Flexible bag 365 is staked to fitment 367 that is preferably press-fit into crown 361. Preferably pen body 360 and crown 361 are made from a thermoplastic polymer utilizing conventional injection molding equipment. Fitment 367 includes vent 369 to ambient pressure in the shape of a helical, labyrinth path. Vent 369 connects to, and is in fluid communication with, the inside of flexible bag 365, so that flexible bag 365 is maintained at a reference pressure. The helical path reduces the diffusion of fluid out of fluid container 310 via diffusion through flexible bag 365.

Regulator lever 362 rotates about two opposed axles (not shown) that form the axis of rotation of regulator lever 362. When regulator lever 362 engages filter assembly 320 the rotation of the lever is stopped. Approximately perpendicular to the plane of regulator lever 362 is a valve seat (not shown) that is formed of a resilient material. In response to the expansion or contraction of flexible bag 365, regulator lever 362 rotates about the axles (not shown) causing the valve seat (not shown) to open and close against a mating surface on crown 361. This rotational motion of regulator lever 362 regulates the flow of fluid into fluid container 310 via septum 351. Accumulator lever 364 and flexible bag 365 operate together, in a similar manner as that described for regulator lever 362, to accommodate changes in volume due to any air that may be entrapped in fluid ejection cartridge 300, as well as due to other pressure changes, such as a change in altitude. For a more detailed description of the structure and operation of such a regulator as depicted in FIG. 3*a*, see U.S. Pat. No. 5,872,584.

Figure 3B:
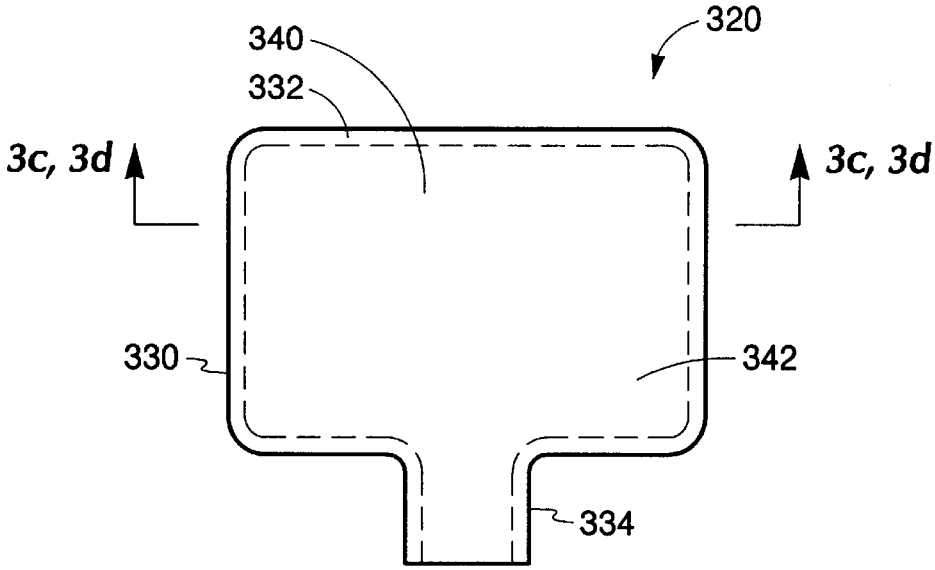
FIG. 3*b* is a plan view of a filter assembly according to an embodiment of the present invention.
Figure 3C:
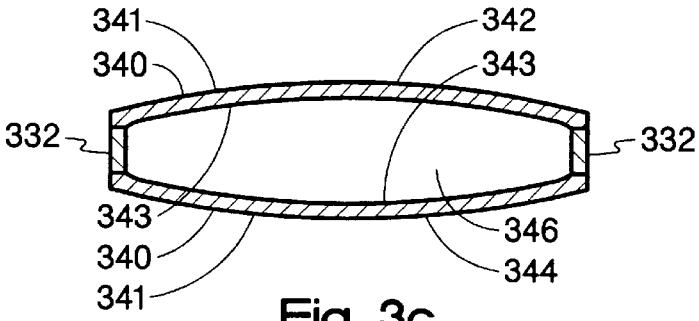
FIG. 3*c* is a cross-sectional view of a filter assembly according to an embodiment of the present invention.
Figure 3D:
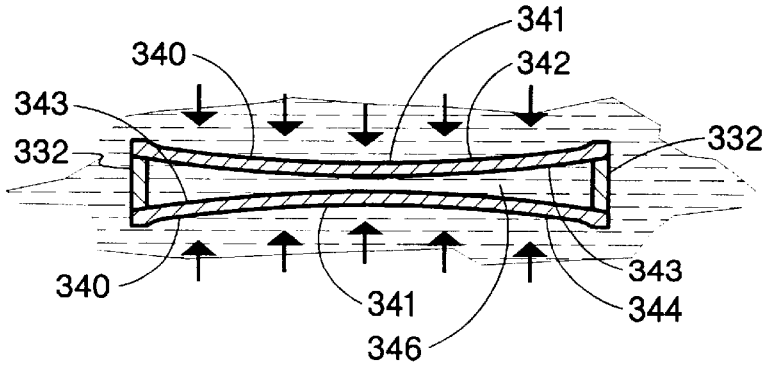
FIG. 3*d* is a cross-sectional view of a filter assembly according to an embodiment of the present invention.

When regulator lever 362 rotates causing the valve seat to open fluid will flow through septum 351 into fluid container 310 applying a force (i.e. the back pressure of a fluid delivery system) to compliant portion 340 that includes filter material 342. This applied force or pressure changes the substantially convex shape of outer surface 341 of filter material 342 as shown in FIG. 3*c* to a substantially concave shape as shown in FIG. 3*d* with a corresponding decrease in internal volume 346 of compliant portion 340. This change in internal volume 346 of compliant portion 340 acts to provide a more gradual rise in pressure observed in the vicinity of the one or more fluid ejectors disposed on substrate 372 of fluid ejector head 370. As fluid ejection cartridge fills with fluid, flexible bag 365 deflates urging regulator lever 362 to rotate in the opposite direction causing the valve seat to close, thereby decreasing the force or pressure of the fluid delivery system on compliant portion 340. This decrease in pressure allows compliant portion 340 to change, from the substantially concave shape as shown in FIG. 3*d*, to a substantially convex shape as shown in FIG. 3*c*, with a corresponding increase in internal volume 346 of compliant portion 340. This increase in internal volume 346 acts to provide a more gradual decrease in pressure observed in the vicinity of the fluid ejectors on substrate 372.

FIGS. 3*a*–3*d* illustrate an exemplary embodiment where fluid flows from the outside of filter assembly 320 through filter material 342 into internal volume 346 and then through filter fitment 334 to standpipe 378. However, fluid ejection cartridge 300 may also be constructed such that filter fitment 334 is fluidically coupled, for example, to septum 351 such that fluid flows into internal volume 346 through filter material 342 to the outside of filter assembly 320 to standpipe 378. In the latter case filter material 342 is formed so that the applied force of the fluid flow is against the substantially convex shape of inner surface 343 of filter material 342. In addition, the amount of deflection will depend on the elasticity of filter material 342. To obtain a particular amount of deflection for a given applied force both the thickness as well as the height and width of filter frame 332, to which filter material 342 is attached, may be modified. The amount of tension, including no tension, applied to filter material 342 may also be varied to further optimize the amount of deflection for a given applied force. By controlling these variables a wide variety of filter materials having a range of elasticities may be utilized. For example, compliant portion 340 may include an elastic filter material such as a woven nylon mesh.

Figure 4:
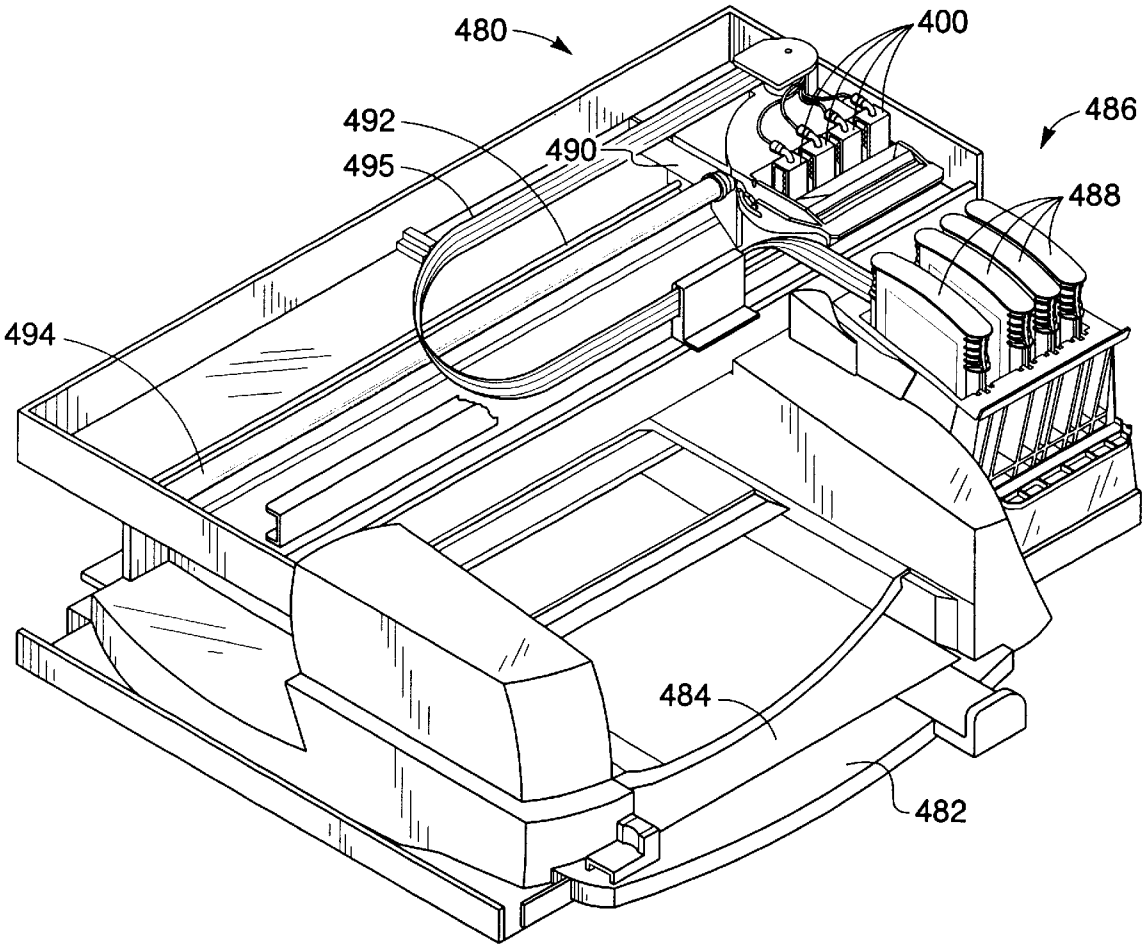
FIG. 4 is a perspective view of a fluid ejection system according to an embodiment of the present invention.

Referring to FIG. 4, a perspective view is shown of an exemplary embodiment of a fluid ejection system of the present invention in. As shown printer 480 includes fluid or ink supply 486, including one or more secondary fluid or ink reservoirs 488 that provide fluid to one or more fluid ejection cartridges 400 commonly referred to as print cartridges. Preferably, print cartridges 400 are similar to fluid ejection cartridge 300 as shown in FIG. 3*a*, however, other fluid ejection cartridges may also be utilized. Secondary fluid reservoirs 488 are fluidically coupled to fluid ejection cartridges via flexible conduit 495. Fluid ejection cartridges 400 may be semi-permanently or removably mounted to carriage 490. In this embodiment, a platen or sheet advancer (not shown) to which print media 484, such as paper, is transported by mechanisms that are known in the art. Carriage 490 is typically supported by slide bar 494 or similar mechanism within fluid ejection system 480 and physically propelled along slide bar 494 to allow carriage 490 to be translationally reciprocated or scanned back and forth across sheet 484. Printer 480 may also employ coded strip 492, which may be optically detected by a photodector (not shown) in carriage 490 for precise positioning of the carriage. Carriage 490 may be translated, preferably, using a stepper motor (not shown), however other drive mechanism may also be utilized. In addition, the motor may be connected to carriage 490 by a drive belt, screw drive, or other suitable mechanism.

When a printing operation is initiated, print media 484 in tray 482 is fed into a printing area (not shown) of printer 480. Once print media 484 is properly positioned, carriage 490 may traverse print media 484 such that one or more print cartridges 400 may eject ink onto print media 484 in the proper position. Print media 484 may then be moved incrementally, so that carriage 490 may again traverse print media 484, allowing the one or more print cartridges 400 to eject ink onto a new position on print media 484. Typically the drops are ejected to form predetermined dot matrix patterns, forming for example images or alphanumeric characters.

Rasterization of the data can occur in a host computer such as a personal computer or PC (not shown) prior to the rasterized data being sent, along with the system control commands, to the system, although other system configurations or system architectures for the rasterization of data are possible. This operation is under control of system driver software resident in the system's computer. The system interprets the commands and rasterized data to determine which drop ejectors to fire. Thus, when a swath of ink deposited onto print media 484 has been completed, print media 484 is moved an appropriate distance, in preparation for the next swath. This invention is also applicable to fluid dispensing systems employing alternative means of imparting relative motion between the fluid ejection cartridges and the print media, such as those that have fixed fluid ejection cartridges and move the print media in one or more directions, and those that have fixed print media and move the fluid ejection cartridges in one or more directions.

Figure 5A:
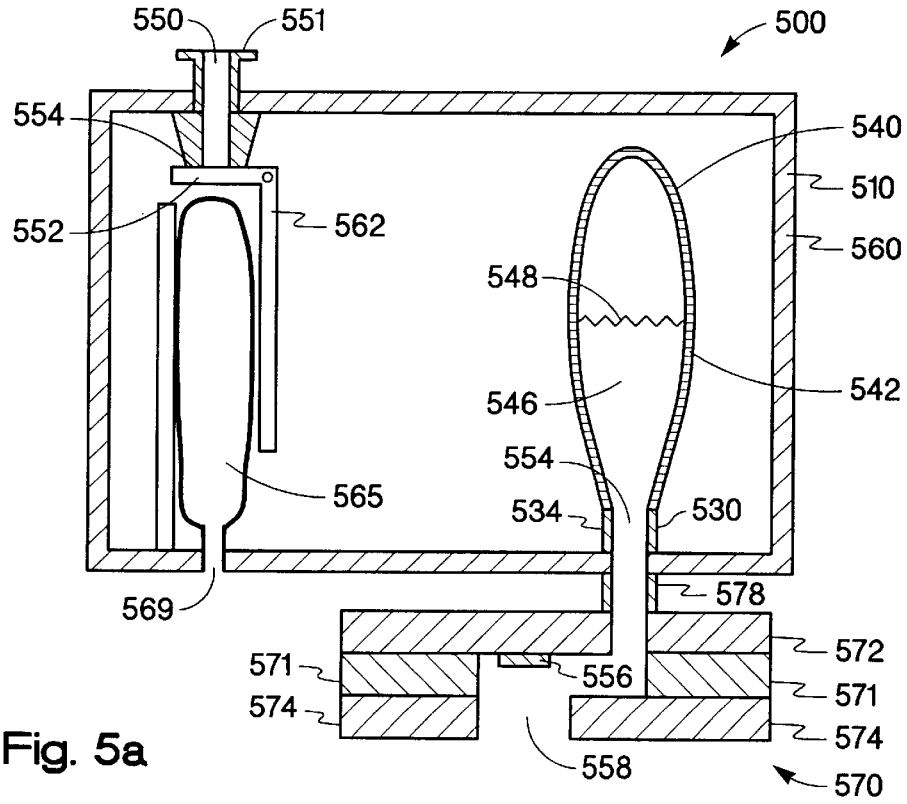
FIG. 5*a* is a cross-sectional view of a fluid ejection cartridge according to an embodiment of the present invention.
Figure 5B:
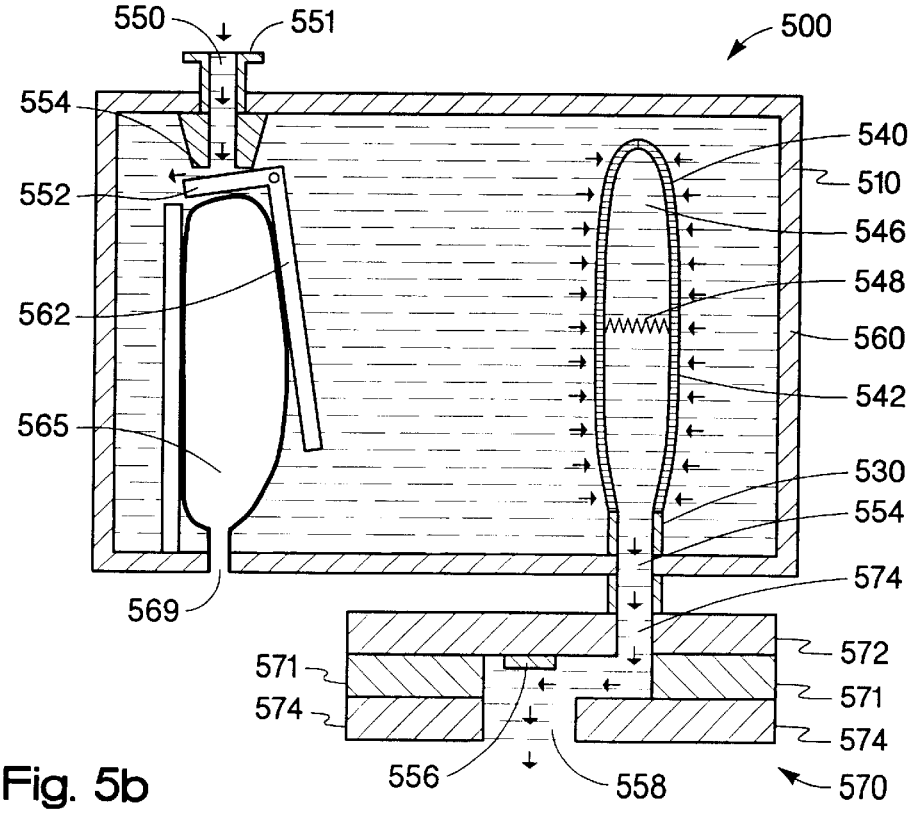
FIG. 5*b* is a cross-sectional view of a fluid ejection cartridge according to an embodiment of the present invention.

Referring to FIG. 5*a* an alternate embodiment of the present invention is shown in a simplified cross-sectional view. The fluid has been omitted from FIG. 5*a* to better provide a clear view of the drawing. In this embodiment, the filter assembly includes filter material 542 formed substantially as a bag acting as compliant portion 540, and sealed to non-compliant portion 530 inside fluid container 510. Filter spring 548 acts to return filter material 542 to an expanded form as fluid flow decreases or stops. Non-compliant portion 530 forms fluid outlet 554 that is fluidically coupled to standpipe 578 which provides a fluid path for fluid flowing to fluid ejector 556. Ejector head 570 is formed by substrate 572, fluid ejector 556, nozzle layer 574, nozzle 558, and chamber layer 571, which defines the side walls of an ejector chamber. Fluid inlet 550 includes septum 551 and is fluidically coupled to fluid container 510. One end of regulator lever 562 forms valve 552 having a valve seat that mates with valve seat 554. Flexible bag 565 and vent 569 perform similar functions as described above, and as shown in FIG. 3*a*.

When regulator lever 562 rotates causing valve 552 to open fluid will flow through septum 551 into fluid container 510 applying a force (i.e. the back pressure of a fluid delivery system) to compliant portion 540 that includes filter material 542. This applied force or pressure causes filter material 542 to deflate as shown in FIG. 3*b* with a corresponding decrease in internal volume 546 of compliant portion 540. The decrease in internal volume 546 compresses filter spring 548. In addition, this decrease in internal volume 546 of compliant portion 540 provides a more gradual rise in pressure observed in the vicinity of the one or more fluid ejectors disposed on substrate 572 of fluid ejector head 570. As fluid ejection cartridge 500 fills with fluid, flexible bag 565 deflates causing valve seat 552 to close decreasing the force or pressure of the fluid delivery system on compliant portion 540. This decrease in pressure causes filter material 542 to expand, via the force exerted by compressed filter spring 548, with a corresponding increase in internal volume 546 of compliant portion 540. The increase in internal volume 546 acts to provide a more gradual decrease in pressure observed in the vicinity of the fluid ejectors on substrate 572.

Although this embodiment, depicts fluid flowing from the outside of the bag formed by filter material 542 it is also possible to form the filter assembly whereby fluid would flow from the inside of the bag to the outside. In such an assembly the bag expands when fluid flows out of the bag placing filter spring 548 in tension producing an increase in internal volume 546. Then as the fluid flow decreases the bag deflates relieving the tension on filter spring 548.

Figure 6A:
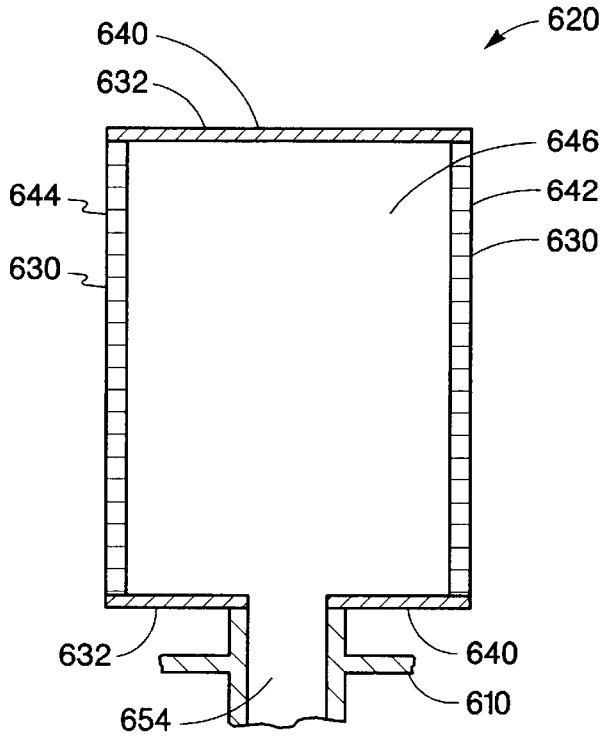
FIG. 6*a* is a cross-sectional view of a filter assembly according to an embodiment of the present invention.

Referring to FIG. 6*a* an alternate embodiment of the present invention is shown in a simplified cross-sectional view. The fluid has been omitted from FIG. 6*a* to better provide a clear view of the drawing. In this embodiment, filter assembly 620 includes filter frame 632 that is compliant and forms compliant portion 640. Filter material 642 and 644 formed in a substantially rigid manner forms non-compliant portion 630, and is sealed to compliant portion 640 disposed inside of fluid container 610. Filter frame 632, preferably, is heat staked to filter material 642 and 644. However, depending on the particular materials utilized for filter material 642 and 644 and filter frame 632, adhesives and other mechanical fastening methods may also be utilized to attach filter material 642 and 644 to filter frame 632.

Figure 6B:
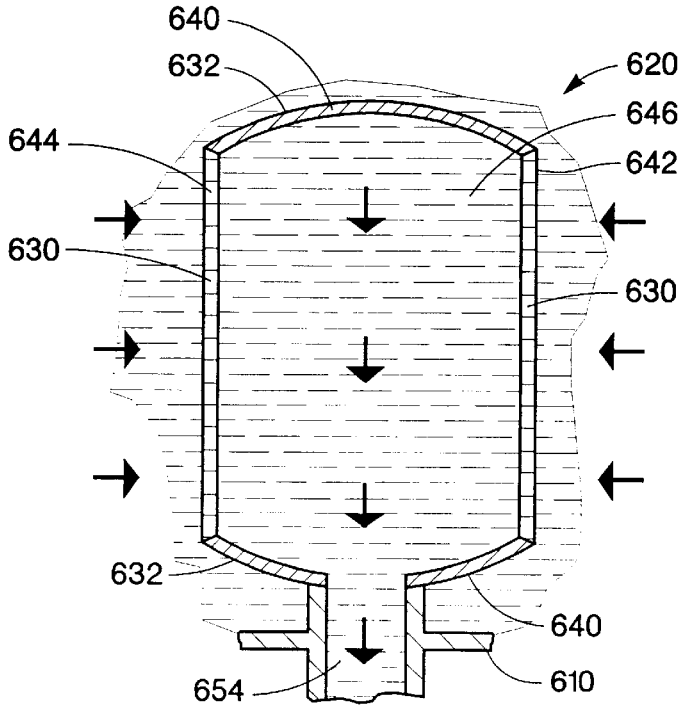
FIG. 6*b* is a cross-sectional view of a filter assembly according to an embodiment of the present invention.

In this embodiment when fluid flows from the outside of filter assembly 620 through filter material 642 and 644 into internal volume 646 filter frame 632 flexes or deforms providing the change in internal volume 646 that provides a more gradual rise in pressure observed in the vicinity of the one or more fluid ejectors. Whether internal volume increases or decreases depends both on the dimensions of filter frame 632 as well as on the elastic properties of the material used to form filter frame 632. Filter frame 632 can be formed from any of the metal or polymer well known in the art. The actual frame material utilized depends both, on the particular application in which the fluid ejection cartridge will be utilized, as well as on characteristics of the filter material such as the materials chemical and thermal robustness. Preferably, the frame material is a thermoplastic polymer, and more preferably an injection moldable thermoplastic polymer such as polyethylene, polypropylene or polyester to name a few. Although FIGS. 6*a* and 6*b* depict a filter assembly utilizing fluid flow from outside the assembly to the internal volume inside the assembly other structures where fluid flows from inside the filter assembly to the outside may also be utilized.

Figure 7A:
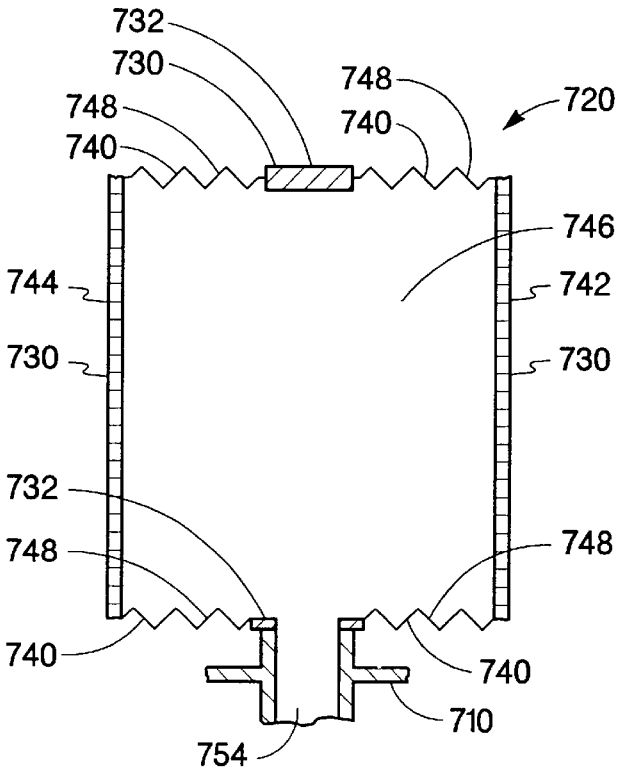
FIG. 7*a* is a cross-sectional view of a filter assembly according to an embodiment of the present invention.
Figure 7B:
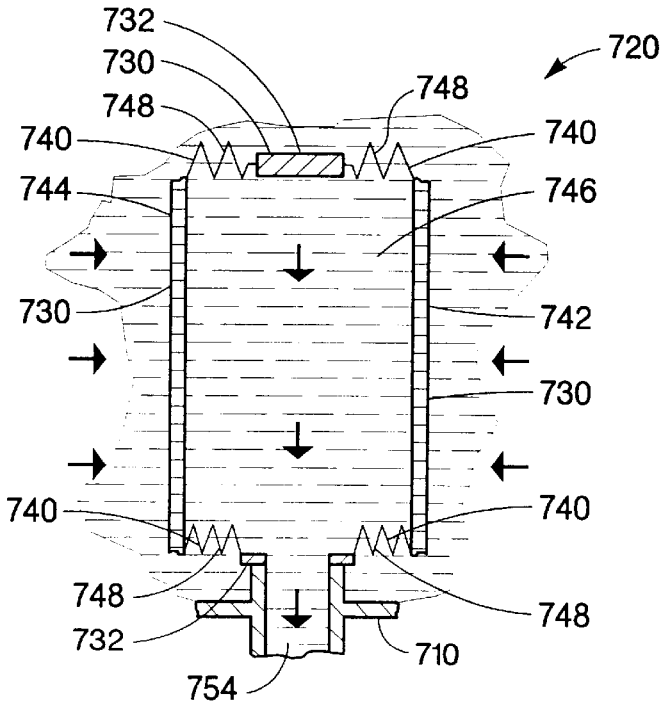
FIG. 7*b* is a cross-sectional view of a filter assembly according to an embodiment of the present invention.

Referring to FIG. 7*a* an alternate embodiment of the present invention is shown in a simplified cross-sectional view. The fluid has been omitted from FIG. 5*a* to better provide a clear view of the drawing. In this embodiment, filter assembly 720 includes pleated portion 748 attached between filter frame 732 and filter material 742 and 744. Pleated portion 748 forms compliant portion 740 and filter frame 732 and filter material 742 and 744 form non-compliant portion 730. However, filter material 742 and 744 may each be attached to a first and a second filter frame respectively with pleated portion 748 attached to first and second filter frames. In this embodiment, when fluid flows from the outside of filter assembly 720 through filter material 742 and 744 into internal volume 746 pleated portion 748 contracts as shown in FIG. 7*b*. This contraction provides a decrease in internal volume 746 that results in a more gradual rise in pressure observed in the vicinity of the one or more fluid ejectors. As the fluid ejection cartridge fills with fluid, pleated portion 748 expands with a corresponding increase in internal volume 746.

Filter frame 732 and pleated portion 748 can be formed from either metal or polymer or some combination thereof. The actual frame material and pleat material utilized depends both, on the particular application in which the fluid ejection cartridge will be utilized, as well as on characteristics such as the materials mechanical properties and chemical robustness. Preferably, the frame and pleat material is a thermoplastic polymer, and more preferably an injection moldable thermoplastic polymer such as polyethylene, polypropylene or polyester to name a few.

While the present invention has been particularly shown and described with reference to the foregoing preferred and alternative embodiments, many variations may be made therein without departing from the spirit and scope of the invention as defined in the following claims. For example, FIGS. 3*a*–3*d* depict an embodiment where the filter frame is rigid and the filter material is compliant, whereas the embodiment shown in FIGS. 6*a*–6*b* depicts the filter frame as complaint and the filter material as rigid. Embodiments having attributes of both may also be utilized in the present invention where the filter frame and the filter material have some degree of compliance. Thus, the foregoing embodiments are illustrative, and no single feature or element is essential to all possible combinations that may be claimed.

What is claimed is:

1. A fluid ejection cartridge comprising:

a fluid container having a fluid inlet and a fluid outlet;

at least one fluid ejector fluidically coupled to said fluid container outlet;

a fluid regulator fluidically coupled to said fluid container inlet; and a filter assembly having a compliant portion with an internal volume fluidically coupled to said fluid container outlet wherein said internal volume changes when fluid flows into said fluid container.

2. The fluid ejection cartridge of claim 1, wherein said fluid regulator further comprises a fluid valve.

3. The fluid ejection cartridge of claim 2, wherein said fluid valve further comprises a septum.

4. The fluid ejection cartridge of claim 1, wherein said fluid regulator is disposed within said fluid container.

5. The fluid ejection cartridge of claim 1 wherein said filter assembly is disposed within said fluid container.

6. The fluid ejection cartridge of claim 1, wherein said fluid regulator further comprises at least one lever.

7. The fluid ejection cartridge of claim 6, wherein said at least one lever further comprises a valve seat.

8. The fluid ejection cartridge of claim 1, wherein said filter assembly further comprises a filter frame.

9. The fluid ejection cartridge of claim 8, wherein said filter frame is compliant.

10. The fluid ejection cartridge of claim 9, further comprises a rigid filter material attached to said compliant frame.

11. The fluid ejection cartridge of claim 8, wherein said filter frame forms a non-compliant portion of said filter assembly.

12. The fluid ejection cartridge of claim 1, wherein said compliant portion further comprises a filter material formed as a bag.

13. The fluid ejection cartridge of claim 1, wherein said filter assembly further comprises a thermoplastic polymer filter frame.

14. The fluid ejection cartridge of claim 1, wherein said filter assembly further comprises a rigid filter media attached to said compliant portion, and said compliant portion is attached to a filter frame.

15. The fluid ejection cartridge of claim 14, wherein said compliant portion further comprises a pleated portion.

16. The fluid ejection cartridge of claim 1, wherein said filter assembly further comprises a rigid filter media attached to a filter frame and said filter frame is attached to said compliant portion.

17. The fluid ejection cartridge of claim 16, wherein said compliant portion further comprises a pleated portion.

18. The fluid ejection cartridge of claim 1, wherein said filter assembly further comprises a filter frame wherein said compliant portion includes an elastic filter material mounted to said filter frame.

19. The fluid ejection cartridge of claim 1, wherein said fluid inlet is fluidically coupled to a secondary fluid reservoir.

20. The fluid ejection cartridge of claim 1, further comprising:

a substrate wherein said at least one fluid ejector is disposed on said substrate;

a chamber layer disposed on said substrate, wherein said chamber layer defines an ejection chamber; and a nozzle layer containing at least one nozzle fluidically coupled to said at least one fluid ejector.

21. The fluid ejection cartridge of claim 20, wherein said fluid container, said filter assembly, said substrate, and said nozzle layer are formed as an integral replaceable unit.

22. The fluid ejection cartridge of claim 1, wherein said fluid container further comprises an ejectable fluid.

23. The fluid ejection cartridge of claim 1, wherein said filter assembly includes a filter material having a mean pore size range from about one micron to about 50 microns.

24. The fluid ejection cartridge of claim 1, wherein said filter assembly includes a filter material having a mean pore size range from about two microns to about 10 microns.

25. The fluid ejection cartridge of claim 1, wherein said filter assembly further comprises a filter material having a flow rate of between 20 milliliters per minute to about 300 milliliters per minute at a pressure less than about eight inches of water and at a viscosity of less than about 25 centipoise.

26. The fluid ejection cartridge of claim 1, wherein said filter assembly further comprises a filter material having a flow rate of between 40 milliliters per minute to about 100 milliliters per minute at a pressure less than about five inches of water and at a viscosity of less than about 15 centipoise.

27. The fluid ejection cartridge of claim 1, wherein said filter assembly further comprises a filter material having a flow rate of between 45 milliliters per minute to about 55 milliliters per minute at a pressure less than about 2 inches of water and at a viscosity of less than about 5 centipoise.

28. The fluid ejection cartridge of claim 1, wherein said filter assembly further comprises a polymer filter material.

29. The fluid ejection cartridge of claim 28, wherein said polymer filter material includes a polysulfone porous membrane.

30. The fluid ejection cartridge of claim 28, wherein said polymer filter material includes a polytetrafluoroethylene porous membrane.

31. A fluid ejection cartridge comprising:

a fluid container having a fluid inlet and a fluid outlet;

at least one fluid ejector fluidically coupled to said fluid container outlet;

a fluid regulator fluidically coupled to said fluid container inlet; and a filter assembly disposed within said fluid container, comprising:

a thermoplastic polymer filter frame; and a compliant polymer filter material attached to said thermoplastic polymer filter frame, forming a compliant portion, having an internal volume fluidically coupled to said fluid container outlet wherein said internal volume changes when fluid flows into said fluid container.

32. A fluid dispensing system comprising:

at least one fluid ejection cartridge of claim 1;

at least one secondary fluid reservoir;

at least one flexible fluid conduit fluidically coupling said at least one secondary fluid reservoir to said at least one fluid ejection cartridge; and a sheet advancer for advancing a print media, wherein said sheet advancer and said at least one fluid ejection cartridge are capable of dispensing fluid on a first portion of said print media.

33. The fluid dispensing system of claim 32, wherein said sheet advancer and said drop-firing controller are capable of dispensing said fluid in a two dimensional array on said first portion and on a second portion of said sheet.

34. A method of manufacturing a fluid ejection cartridge comprising the steps of:

forming a fluid container having a fluid inlet and a fluid outlet;

creating at least one fluid ejector fluidically coupled to said fluid container outlet; and mounting a filter assembly to said fluid outlet, wherein said filter assembly includes a compliant portion with an internal volume fluidically coupled to said fluid container outlet wherein said internal volume changes when fluid flows into said fluid container.

35. The method of claim 34, further comprising the step of forming a fluid regulator fluidically coupled to said fluid container inlet.

36. The method of claim 35, wherein said step of forming a fluid regulator further comprises the step of forming a helical labyrinth path to atmospheric air.

37. The method of claim 35, wherein said step of forming a fluid regulator further comprises the step of forming a fluid valve.

38. The method of claim 34, wherein said step of mounting a filter assembly further comprises the step of forming a filter material as a bag.

39. The method of claim 34, wherein said step of mounting a filter assembly further comprises the step of forming a filter frame.

40. The method of claim 39, wherein said step of forming a filter frame further comprises the step of forming a compliant filter frame.

41. The method of claim 40, wherein said step of forming a compliant filter frame further comprises the step of attaching a rigid filter material to said complaint filter frame.

42. The method of claim 39, wherein said step of forming a filter frame further comprises the step of forming a rigid filter frame.

43. The method of claim 42, wherein said step of forming a rigid filter frame further comprises the step of attaching a compliant filter material to said rigid filter frame.

44. The method of claim 34, wherein said step of mounting a filter assembly further comprises the step of attaching a rigid filter material to said compliant portion, and said compliant portion is attached to a filter frame.

45. The method of claim 44, wherein said attaching step further comprises the step of attaching said rigid filter material to a pleated portion, and said pleated portion is attached to a filter frame.

46. The method of claim 34, wherein said step of mounting a filter assembly further comprises the step of attaching a rigid filter material to a filter frame and said filter frame is attached to said compliant portion.

47. The method of claim 46, wherein said attaching step further comprises the step of attaching said rigid filter material to a filter frame and said filter frame is attached to a pleated portion.

48. The method of claim 34, wherein said step of mounting a filter assembly further comprises the step of mounting an elastic filter media to a rigid frame.

49. The method of claim 34, further comprises the step of fluidically coupling said fluid inlet to a secondary fluid reservoir.

50. The method of claim 34, further comprises the steps of:

forming a substrate wherein said at least one fluid ejector is disposed on said substrate;

creating an ejection chamber disposed on said substrate; and creating a nozzle layer having at least one nozzle fluidically coupled to said at least one fluid ejector.

51. The method of claim 34, further comprises the step of creating said fluid container, said filter assembly, said substrate, and said nozzle layer as an integral replaceable unit.

52. The method of claim 34, further comprises the step filling said fluid container with an ejectable fluid.

53. The fluid ejection cartridge made by method 34.

54. A method of using a fluid ejection cartridge comprising the steps of:

containing a fluid within a fluid container having a fluid inlet and a fluid outlet;

coupling at least one fluid ejector to said fluid container outlet;

regulating said fluid in said fluid container at a predetermined level;

filtering said fluid through a fluid assembly having a compliant portion with an internal volume fluidically coupled to said fluid container outlet; and changing said internal volume when fluid flows into said fluid container.

55. The method of claim 54, further comprising the step of ejecting fluid from said at least one fluid ejector.

* * * * *

UNITED STATES PATENT AND TRADEMARK OFFICE

CERTIFICATE OF CORRECTION

PATENT NO. : 6,702,436
DATED : March 9, 2004
INVENTOR(S) : Haines et al.

It is certified that error appears in the above-identified patent and that said Letters Patent is hereby corrected as shown below:

Column 11,
Line 61, delete “complaint” and insert therefor -- complaint --.

Signed and Sealed this

Thirty-first Day of August, 2004

JON W. DUDAS
*Director of the United States Patent and Trademark Office*